United States Patent [19]

Straub

[11] Patent Number: 5,044,515

[45] Date of Patent: Sep. 3, 1991

[54] COASTER CARRIER AND COASTER

[76] Inventor: Albert H. Straub, 13060 Skyline Blvd., Woodside, Calif. 94062

[21] Appl. No.: 534,746

[22] Filed: Jun. 7, 1990

Related U.S. Application Data

[60] Division of Ser. No. 178,765, Mar. 25, 1988, Pat. No. 4,940,137, which is a continuation-in-part of Ser. No. 932,451, Nov. 18, 1986, abandoned.

[51] Int. Cl.[5] ..... B65D 23/12; B65D 23/10

[52] U.S. Cl. ..... 220/630; 215/100 R; 215/100.5; 248/346.1; 206/144

[58] Field of Search ..... 215/100.5, 100 R; 248/346.1; 220/85 H, 628, 630

[56] References Cited

U.S. PATENT DOCUMENTS

| | | | |
|---|---|---|---|
| 845,777 | 3/1907 | Grossman | 215/100 R |
| 1,056,882 | 3/1913 | Bonn | 215/100 R |
| 2,779,495 | 1/1957 | Davis | 215/100.5 |
| 4,510,665 | 4/1985 | Scheurer | 215/100.5 X |
| 4,796,937 | 1/1989 | Andrea | 220/85 H |

FOREIGN PATENT DOCUMENTS

| | | | |
|---|---|---|---|
| 589945 | 3/1925 | France | 248/346.1 |

*Primary Examiner*—William I. Price

*Attorney, Agent, or Firm*—Flehr, Hohbach, Test, Albritton & Herbert

[57] ABSTRACT

A carrier (10) for a six pack (20) of beverage containers (14) has rings (12) interconnected by strips (16) and (18). The rings (12) fit around the beverage containers (14) in a friction fit. The strips (16, 18) are severed from adjacent rings (12) to remove one of the beverage containers (14) from the six pack (20). The ring (12) is moved so that it extends partially below bottom (24) of the container (14) so that the ring (12) will function as a coaster by supporting the container (14) above a surface (26) to prevent condensation on the container (14) from contacting the surface (26).

3 Claims, 4 Drawing Sheets

COASTER CARRIER AND COASTER

This is a division, of application Ser. No. 178,765 filed Mar. 25, 1988 now U.S. Pat. No. 4,990,137, which is a continuation-in-part of application Ser. No. 06/932,451, filed Nov. 18, 1986, now abandoned.

BACKGROUND OF THE INVENTION

1. Field of the Invention

This invention relates to an improved form of a coaster and carrier for beverage containers. More particularly, it relates to a structure which serves as a carrier for a six pack or other multiple group of beverage containers and as coasters for individual beverage containers when separated from the group. It further relates to an improved form of a coaster.

2. Description of the Prior Art

A variety of coaster designs for beverage containers are known in the art. Examples of such coasters and related devices are disclosed in the following issued U.S. Pat. Nos.: 2,115,654, issued Apr. 26, 1938 to Swofford; 2,706,571, issued Apr. 19, 1955 to Ryan; 2,727,645, issued Dec. 20, 1955 to Dore; 3,257,025, issued June 21, 1966 to Jolly; 3,268,198, issued Aug. 23, 1966 to Swett; 3,613,761, issued Oct. 19, 1971 to Moody; 3,633,863, issued Jan. 11, 1972 to Abbey; 4,020,968, issued May 3, 1977 to Chiavola et al.; 4,372,453, issued Feb. 8, 1983 to Branscum. While these coaster designs are generally satisfactory for their intended purpose of preventing beverage stains on tables and other supporting surfaces for the beverage containers, further simplification of them would be desirable.

It is also known to provide a carrier for six packs of beverage containers consisting of interconnected flexible plastic rings which fit around the beverage containers in the six pack. However, this carrier has come into disfavor with environmentalists because of the hazards it presents to wildlife when discarded.

SUMMARY OF THE INVENTION

Accordingly, it is an object of this invention to provide an improved coaster design which can be provided as part of a carrier for beverage container six packs and other groups of the beverage containers.

It is another object of the invention to provide such an improved combined coaster and carrier design that can be fabricated from plastic in a single molding step.

It is a further object of the invention to provide such an improved combined coaster and carrier design that is configured to allow messages to be provided on the coasters.

It is still another object of the invention to provide such an improved combined coaster and carrier design in which the coasters can be joined together in modular fashion to provide a carrier for a group of varying numbers of beverage containers.

It is a still further object of the invention to provide a simplified coaster suitable for use with cups and mugs having handles.

These and related objects may be achieved through use of the novel coaster and beverage container carrier herein disclosed. A coaster and carrier for beverage containers in accordance with the invention has a plurality of interconnected rings. Each ring has a side extending parallel to an axis of the ring. Each ring is removable from a remainder of the plurality of interconnected rings. Each of the plurality of interconnected rings is dimensioned to fit around one of the beverage containers in a friction fit. Each of the rings has sufficient rigidity to support the one of the beverage containers above a horizontal supporting surface when the ring is moved to extend partially beyond a bottom of the one of the beverage containers.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
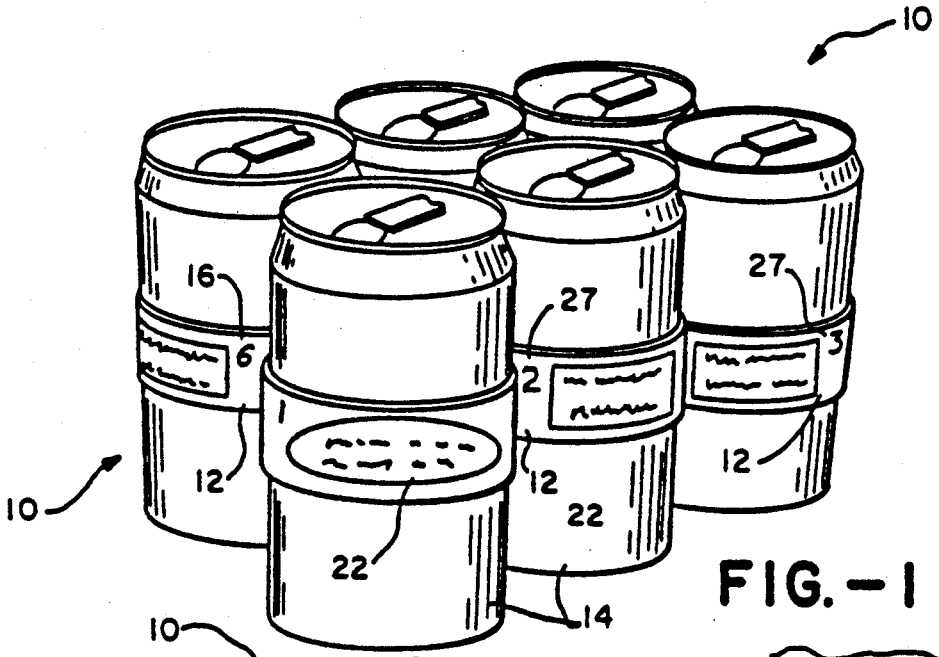
FIG. 1 is a perspective view of a combined beverage container carrier and coasters in accordance with the invention.
Figure 2:
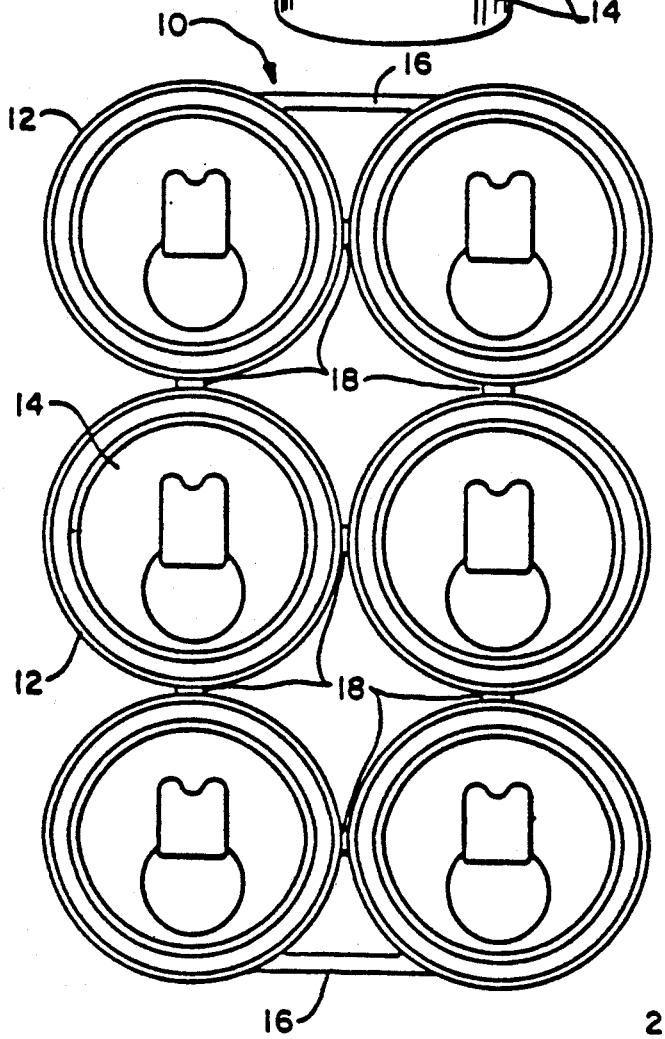
FIG. 2 is a plan view of the combined beverage container carrier and coasters of FIG. 1.

Turning now to the drawings, more particularly to FIGS. 1 and 2, there is shown a combined beverage carrier and coasters 10 in accordance with the invention. The combination 10 includes a plurality of rings 12, one of each of which encircles one of the beverage cans 14 in a friction fit. Strips 16 and 18 interconnect the rings 12. The strips 16 at either end of the combination 10 are used to carry the six pack 20 of the containers 14. The rings 12 have a width of about 1 inch Their configuration allows them to carry advertising or public service messages 22. The combination 10 is desirably formed from a suitable plastic material having enough rigidity to support a full beverage container 14 in the manner shown in FIG. 3. Of course, the combination 10 could be formed from a variety of other materials, such as metal, cardboard, styrofoam, or the like. The combination 10 is desirably fabricated in a single molding operation.

In use, the combination 10 is used to carry and store the six pack 20 prior to consumption of the beverage in the containers 14. When it is desired to consume the beverage, one of the containers 14 is separated from the six pack 20 by pulling the strips 16 and 18 apart. The strips 16 and 18 are thin enough so that only a moderate amount of force is required to sever them. The user slides the ring 12 down to the position shown in FIG. 3 in order to use the ring 12 as a coaster for the container 14. In this position, the ring 12 spaces bottom 24 of the container 14 above table 26 or other supporting surface. Condensation on the container 14 therefore does not contact the table 26. Because the plastic ring 12 is thermally insulating, no condensation forms on its surface. In practice, numbers may be placed on the rings 12, as indicated at 27, as an aid to locating a user's container 14 at a party or other situation in which substantial numbers of the containers 14 are about. The rings 12 can also be provided in various colors, for example, for color coding of different flavors or types of a beverage product.

Figure 3A:
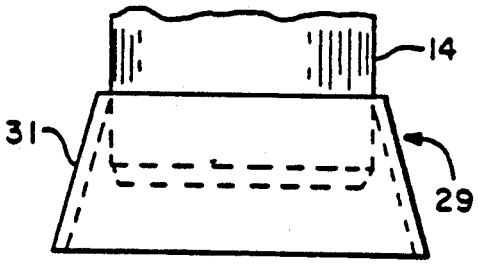
FIG. 3A is a side view of one of the coasters in another embodiment of the invention in use.

FIG. 3A shows another form of a coaster 29 that has tapered sides 31 which flare outward from the beverage container 14 in order to prevent tipping of the container 14. The coaster 29 can also be provided as part of a six pack carrier, as in the FIGS. 1 and 2 embodiment.

Figure 3:
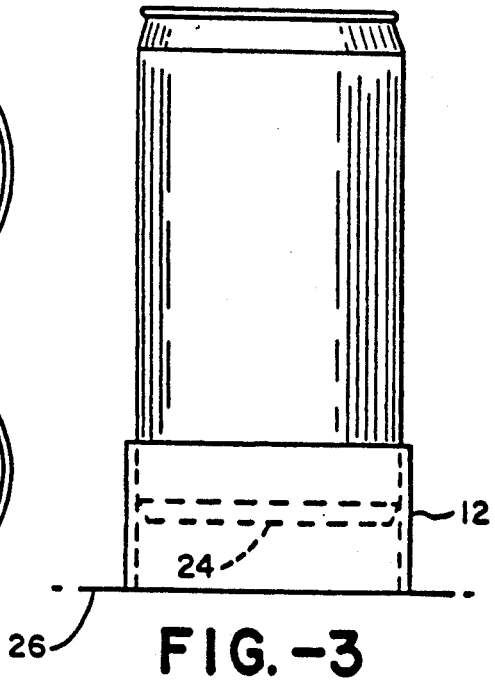
FIG. 3 is a side view of one of the coasters in the combined beverage container carrier and coasters of FIGS. 1 and 2 in use.
Figure 4:
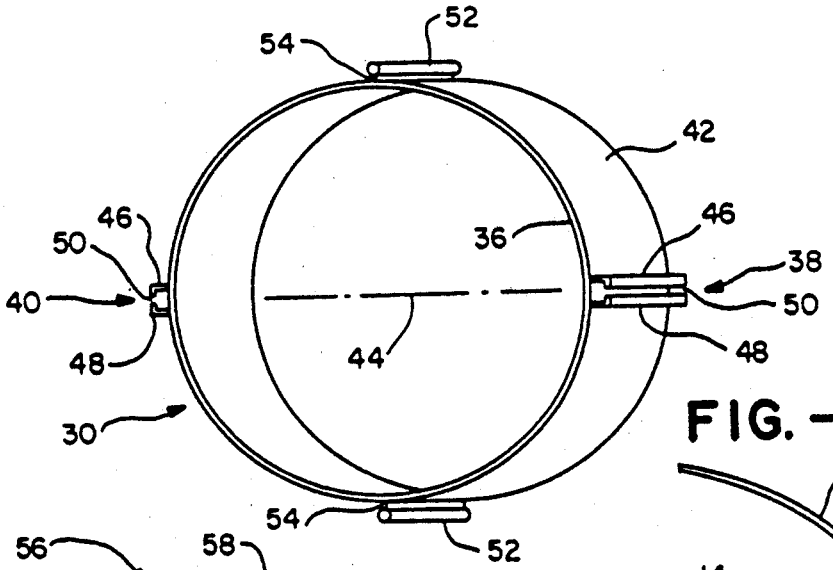
FIG. 4 is a perspective view of another embodiment of a coaster in accordance with the invention.
Figure 5:
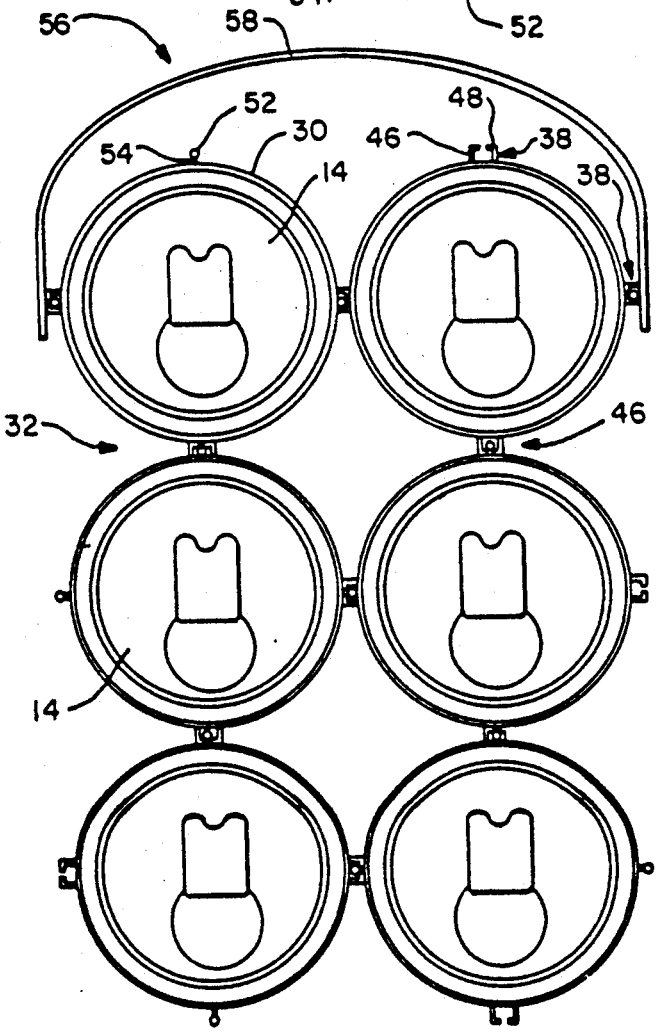
FIG. 5 is a plan view of a beverage container carrier formed from a plurality of the coasters of FIG. 4.
Figure 6:
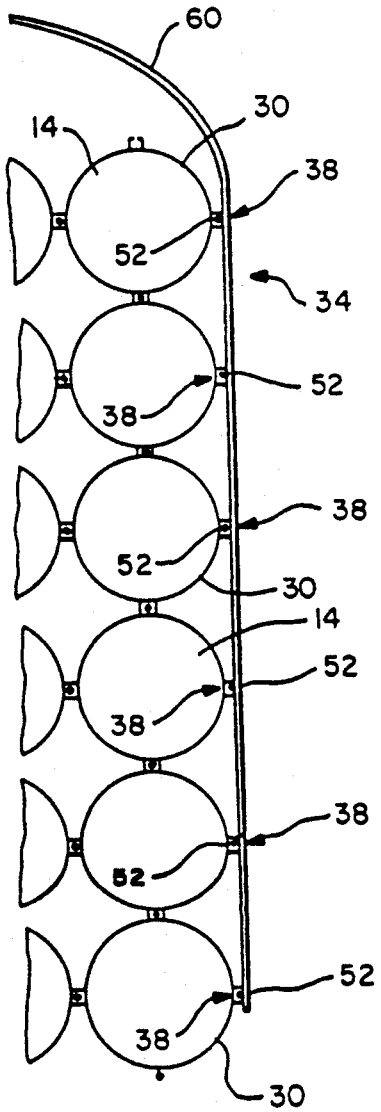
FIG. 6 is a partial plan view of another beverage container carrier formed from a plurality of the coasters of FIG. 4.

FIG. 4 shows another form of a coaster 30, which may be fastened together in modular fashion to provide a six pack 32 of beverage containers 14, as shown in FIG. 5, or a larger group of the containers 14, such as the case 34 represented in FIG. 6. The coaster 30 consists of a molded plastic ring 36, dimensioned for friction fit on the containers 14, as in the FIGS. 1–3 embodiment. The plastic ring has two channels 38 and 40 projecting from outside surface 42 of the ring 36, spaced at 180 degree intervals on the ring 36, and extending parallel to axis 44 of the ring 36. The channels 38 and 40 are formed from angles 46 and 48 in facing relationship with gap 50 between them. Spaced at 90 degrees on the ring 36 from each of the channels 38 and 40 are a pair of rod projections 52 extending parallel to the channels 38 and 40. The projections 52 are joined to the surface 42 of the ring 36 by strips 54. The rod projections 52 have a diameter greater than the width of the gap 50, so that the rod projections 52 and channels 38 and 40 will slide together from their ends in interlocking relationship, as shown in FIG. 5.

In use, the coasters 30 are placed on the containers 14 at approximately their middle, as in the FIGS. 1–3 embodiment. The containers 14 are then assembled into groups as shown in FIGS. 5 and 6 by interlocking the rod projections with the channels 38 and 40. In addition, a carrying handle 56 for the six pack 32 is formed from a band 58 of the same plastic used to make the coasters 30 is attached to two of the cans 14 by means of a rod projection 52 at one end of the band 58 and a channel 38 at the other end of the band 58. The band 58 has the same width as the ring 36. When the user desires to remove one of the containers 14 from the six pack 32, the user slides the container 14 upward or downward from the plane of the paper as drawn to disengage the container 14 from its adjacent ,containers 14. The rod projections 52 and channels 38, 40 should interlock with sufficient friction so that this endwise disengagement will not occur except when desired. The coaster 30 is moved down on the container 14 to the same position as the coaster 12 in FIG. 3 to support the container 14 above a horizontal surface to prevent condensation on the container 14 from reaching the horizontal surface. Both the coasters 12 and 30 can be reused with other containers of the same diameter as the containers 14. Particularly the coasters 30 can also be used for other purposes, such as a toy construction element for children, for various craft projects, and the like.

In the case lot group 34 of FIG. 6, a similar plastic band 60 attaches to the containers 14 along both sides of the case 34 (only one side is shown in the drawing). The band 60 has alternating rod projections 52 and channels 38 for engaging the channels 38 and the projections 52 of coasters 30 attached to the successive containers 14 along the side.

Figure 7:
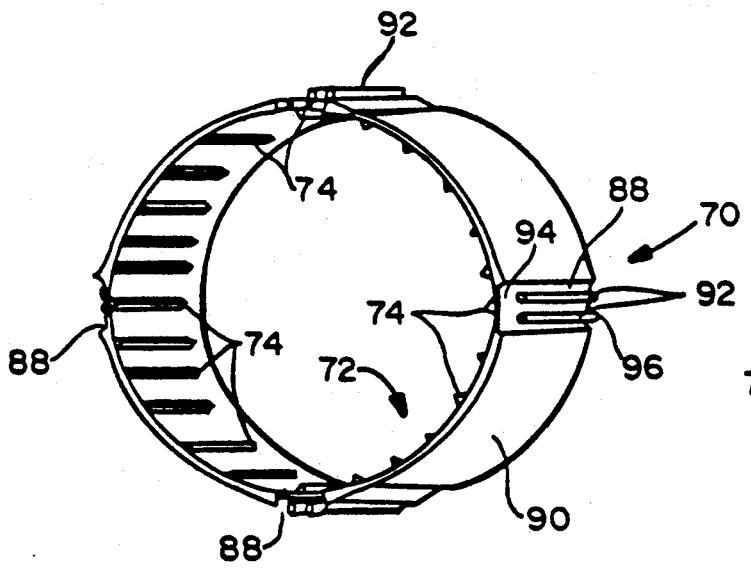
FIG. 7 is a perspective view of still another embodiment of a coaster in accordance with the invention.
Figure 8:
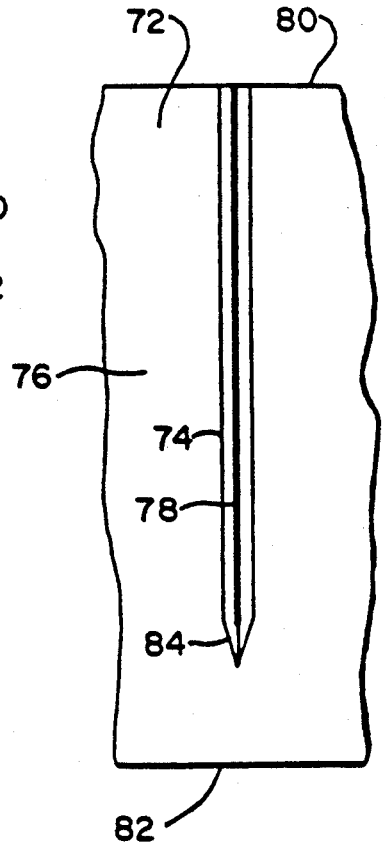
FIG. 8 is an enlarged plan view of a portion of the coaster of FIG. 7.
Figure 9:
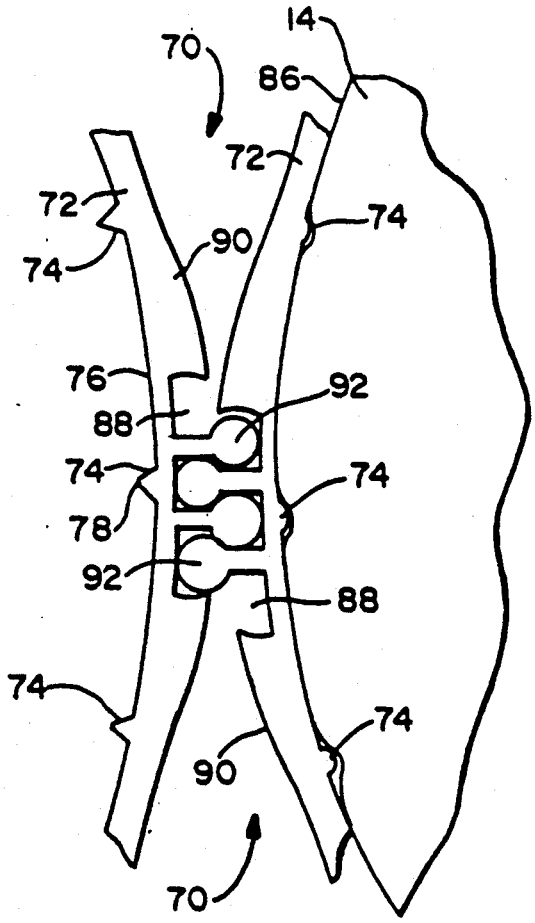
FIG. 9 is an enlarged top view of another portion of two interconnected coasters of FIGS. 7–8.

FIGS. 7–9 show another form of a coaster 70 similar to the coaster 30 of FIGS. 4–6, which also may be fastened together in modular fashion as shown in FIG. 9 to provide a six pack or larger group of beverage containers 14. The coaster 70 is formed from a molded plastic ring 72 dimensioned for friction fit on the containers 14, as in the FIGS. 1–6 embodiments.

In practice, while the containers 14 as fabricated have the same nominal cross section diameter, in fact there is considerable variation in their actual cross section diameters as mass-produced. As a result, when coasters 30 having smooth inside surfaces are placed on the containers 14, there is considerable variation in how tightly the coasters 30 fit on the containers 14. In order to promote more uniformity in the friction fit, the coasters 70 have a plurality of integrally molded, resilient ribs 74 extending axially along their inside surface 76, for example, 20 such ribs equally spaced around the inside surface 76. Such ribs provide increased friction between the containers 14 and the coasters 30, while allowing the coasters to be slid along the containers 14 by hand. The ribs 74 have a substantially triangular cross-section, with a flat top 78 facing toward the center of the ring 72. The ribs 74 extend from top 80 of the ring 72 almost to bottom 82 of the ring 72. When the coaster 70 is slid into place on a container 14, pointed tips 84 of the ribs 74 provide a lead-in for the container onto the ribs 74. As is best shown in FIG. 9, the ribs 74 are partially flattened by the container 14, with wall 86 of the container 14 being slightly deformed by the partially flattened ribs 74. This partial flattening of the ribs 74 compensates for variations in the diameter of different containers 14 to provide a more uniform sliding action of the coasters 70 along the containers 14.

Conventional aluminum cans have a certain amount of such variation in their diameter as fabricated, but glass bottles have a greater variation. Particularly for use with glass bottles, the ribs may be at an angle to the vertical or even horizontal, so that the level of friction is both adequate to support the glass bottles above a surface on which the coaster is rested and to allow the user to slide the coaster along the glass bottles by hand over the size ranges normally encountered with glass bottles.

There are four channels 88 extending axially along outer surface 90 of the ring 72. The channels 88 each have a pair of rod projections 92 extending outward from and along the channels 88. The channels 88 and the rod projections 92 are dimensioned and positioned with respect to one another so that they will interlock together, as shown in FIG. 9, to fasten the coasters 70 together. The combination of the channels 88 and the pair of rod projections 92 provides a more positive interlocking for the coasters 70 than with the coasters 30. As is shown in FIG. 7, the rod projections 92 terminate short of top 94 of the channels 88. This feature makes it easier to line up bottom 96 of the projections 92 with the top 94 of the channels 88 when fastening the coasters 70 together by interlocking their projections 92. This feature could also be implemented by having the projections 92 terminate short of the bottom of the channels 88.

Figure 11:
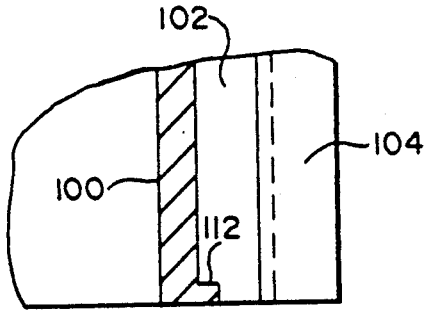
FIG. 11 is a partial cross-section and side view of a portion of one of the coasters in FIG. 10.
Figure 10:
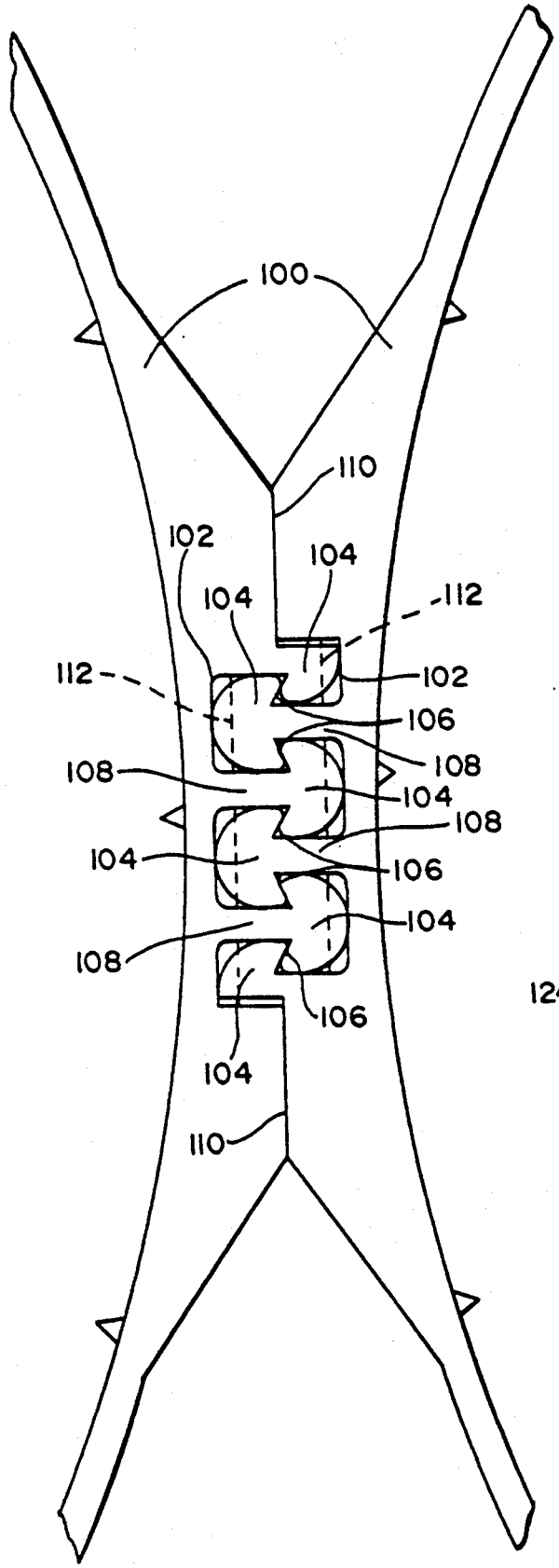
FIG. 10 is an enlarged top view of a portion of another embodiment of two interconnected coasters in accordance with the invention.

FIGS. 10 and 11 show another form of interlocking coasters 100 that are similar in construction to the coasters 70 of FIGS. 7–9, but with modified channels 102 and rod projections 104. The rod projections 104 have angled bases 106 that intersect with supporting webs 108. The angled bases 106 of opposing rod projections 104 interlock to provide secure holding action between the coasters 100 when the rod projections 104 are slid together in the same fashion as with the coasters 70. Mating flat surfaces 110 on each coaster 100 provide additional lateral support for the joined coasters 100 to help prevent lateral twisting separation of the coasters 100. The channels 102 have projecting bases 112 that form stops at their bottom to prevent mating rod projections 104 from sliding downward all the way through when the coasters 100 are joined together. For the same reason, the channels 102, rod projections 104 and the webs 108 have a slight taper to their sides of, for example, 2–3 thousandths of an inch from top to bottom, so that the interlocking fit between the rod projections 104 increases in tightness as they slide together endwise. While the coasters 100 are securely held together by this construction against unintended separation, they are easily separated when desired by moving one of the coasters 100 upward vertically with respect to the other coaster 100, so that the interlocking rod projections 104 slide apart. Other than as shown and described, the construction and operation of the FIGS. 10–11 form of the invention is the same as that of the FIGS. 7–9 form of the invention.

Figure 12:
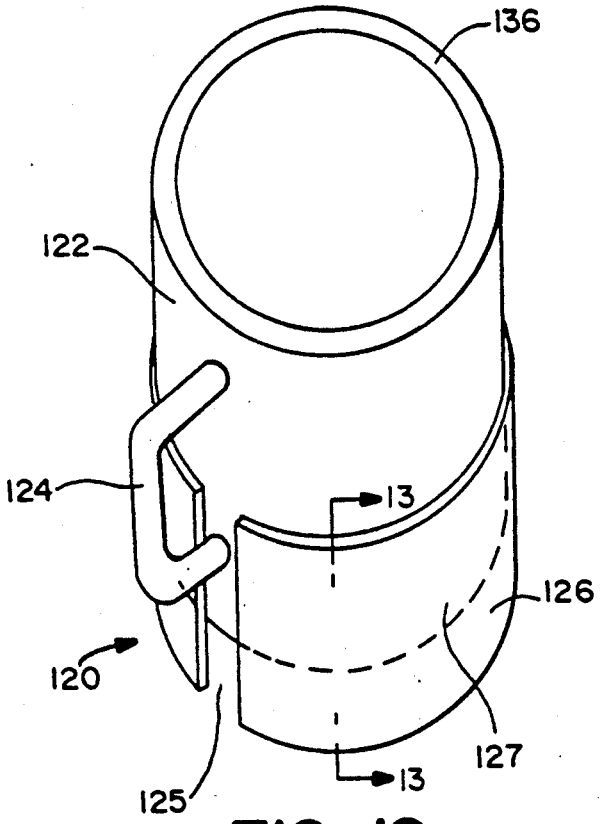
FIG. 12 is a perspective view of another embodiment of a coaster in accordance with the invention in use.
Figure 13:
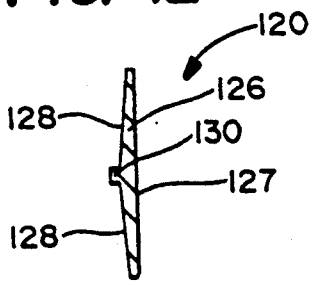
FIG. 13 is a cross-section view, taken along the line 13—13 in FIG. 12.

FIGS. 12–13 show another coaster 120 suitable for use with a cup 122 having a handle 124. The coaster 120 is formed from a wall 126 in the form of a ring of plastic with a substantial spring characteristic, a split. at 125 and a diameter at middle 127 of the wall 126 somewhat less than the diameter of cup 122. Interior surface 128 of the wall 126 tapers inwardly toward stop 130 at the middle 127 of the wall 126. In practice, a taper of about 1/16 to about 1/8 inch from edge to middle of the wall 126 is suitable. In use, the user can attach the coaster 120 by positioning the cup 122 over the coaster 120 and moving it downward into the split ring wall 126 until the cup bottom 132 bottoms out on the stop 130. The split 125 is widened somewhat so that the wall 126 accommodates the cup 122 when this is done. The handle 124 fits within the split 125. The spring of the plastic exerts sufficient force against the cup 122 so that the coaster 120 remains attached to the cup 122 when the cup and the coaster are lifted from supporting surface 134. With the coaster 120 attached to the cup 122, the combination can be stacked on top of another cup 122, and the lower half of the split ring wall 126 will fit over lip 136 of the second cup 122. The taper on the lower half of the split ring wall facilitates such stacking. The coaster 120 may also be used with cans or bottles. As in the case of the coasters of FIGS. 1–11, the coasters 120 may have advertising or other messages on their outer surface.

It should now be readily apparent to those skilled in the art that a novel coaster and carrier for a group of beverage containers capable of achieving the stated objects of the invention has been provided. The coaster is provided as part of a carrier for a group of beverage containers. In one form of the invention, the carrier is fabricated in a single molding step from plastic. In another form of the invention, the carrier is formed from a plurality of the coasters interconnected in a modular fashion. In either form, the coaster is configured to carry advertising or other messages. The carrier is significantly less hazardous to wildlife than conventional plastic strip carriers for beverage containers.

It should further be apparent to those skilled in the art that various changes in form and details of the invention as shown and described may be made. For example, the coasters could be provided in a square configuration, rather than round as shown. The coasters and carrier are usable with other forms of beverage containers than the cans shown, for example, glass or plastic bottles. It is intended that such changes be included within the spirit and scope of the claims appended hereto.

What is claimed is:

1. A coaster for a beverage container, which comprises an open ended ring having a lateral split, said ring having a width which is narrow when compared with a height of the beverage container, being dimensioned to fit around the beverage container in a friction fit, said ring being of a material having a sufficient spring property so that the friction of the friction fit is sufficient to hold said ring at the bottom end of the beverage container and extending partially beyond the bottom end of the beverage container, said ring having a sufficient rigidity to support the beverage container above a horizontal supporting surface when said ring extends partially beyond the bottom end of the beverage container, an inner wall of said ring being tapered inward from an outer edge toward a point of said inner wall intermediate between a top and a bottom of said inner wall, said inner wall having a projecting stop for the beverage container at the point.

2. The coaster for a beverage container of claim 1 in which the point of said inner wall is a midpoint of said inner wall.

3. The coaster for a beverage container of claim 1 in which said inner wall is tapered from both the top and the bottom of said inner wall to the point of said inner wall.

* * * * *